United States Patent [19]

Weaver

[11] 4,154,255

[45] May 15, 1979

[54] ARTICLE RETAINING WEB FOR USE WITH BEACH UMBRELLAS

[76] Inventor: Robert Weaver, 365 Newtown Rd., Warminster, Pa. 18974

[21] Appl. No.: 927,281

[22] Filed: Jul. 24, 1978

[51] Int. Cl.[2] ..... A45B 11/00; A45B 23/00; A45B 25/28

[52] U.S. Cl. ..... 135/16

[58] Field of Search ..... 135/16, 5 E

[56] References Cited

U.S. PATENT DOCUMENTS

| | | | |
|---|---|---|---|
| 2,616,571 | 11/1952 | Griffin | 135/16 |
| 3,434,484 | 3/1969 | Dilullo | 135/16 |
| 3,782,435 | 1/1974 | Sherman | 135/16 |

*Primary Examiner*—Reinaldo P. Machado
*Attorney, Agent, or Firm*—Benasutti Associates, Ltd.

[57] ABSTRACT

A novel article retaining web for use with beach umbrellas is disclosed. The web is designed for use with an umbrella having a central supporting pole, a plurality of spokes pivotally attached thereto and a plurality of struts extending from a position along the pole generally upwardly to engage the spokes to brace the same when the umbrella is in the open position. The web is characterized by a substantially circular flexible net having a central aperture defined therein, a substantially inelastic reinforcing strip disposed around the perimeter of the net, and a plurality of attachments periodically disposed along the reinforcing strip, one for each spoke of the umbrella for suspending the web from the umbrellas spokes. The sizing and spacing of the above-mentioned components is such that article access apertures are created between portions of the umbrella located between the spokes and the portions of the webbing suspended from those spokes.

16 Claims, 5 Drawing Figures

ARTICLE RETAINING WEB FOR USE WITH BEACH UMBRELLAS

BACKGROUND OF THE INVENTION

It has long been a problem to store light, portable articles which may be desired for use in outdoor recreational locations. These articles may include, for example, cameras, glasses, jewelry, billfolds, towels, binoculars, hats, radios, etc. which are desired for use in outdoor recreational locations such as on the beach, at pool side, in back yards, in camp sites, etc. Lack of suitable storage containers for use in these environments is often detrimental to the articles to be stored due to their exposure to dirt, moisture, rain, wind, sand, pilferage children and/or animals in these environments. Closed containers, sometimes used for protective purposes are often bulky, heavy, difficult to transport, and readily susceptible to the collection of sand, dirt, grit, etc. which may be present at a given recreational location. Furthermore, closed containers and the like do not provide convenient access to the articles stored therein. The inconvenience of using closed containers often results in certain articles which should be protected being left in plain view. Finally, the heat generated within those containers is often detrimental to the items such as food, photographic film, cosmetic products etc. which may be stored therein.

SUMMARY OF THE INVENTION

The present invention relates to the field of temporary containers for articles used at recreational locations.

The preferred embodiment of the present invention comprises a substantially circular flexible net which is reinforced around its outer perimeter with an inelastic reinforcing strip. A central aperture is provided in the net and a plurality of ties attached periodically around the periphery of the reinforcing strips is provided for attaching the web to the undersurface of a beach umbrella, and more particularly to the spokes of that umbrella such that the web will be suspended therefrom with its aperture spaced around the pole of the umbrella. In the preferred embodiment, the net is sized and positioned with respect to the umbrella such that convenient scallop or crescent-shaped access apertures are formed between the undersurface of the umbrella and the top surface of the net. These access apertures open in planes substantially perpendicular to the undersurface of their adjacent umbrella fabric, thereby maximizing access convenience. Additionally these apertures are maintained in size and position regardless of the loading configuration of articles stored therein. Additionally, the central net aperture is oversized with respect to the pole so that upon loading one section of the web with articles to be stored the net does not bind against the pole to an unacceptable degree.

Articles stored in the preferred embodiment web are held out of the reach of children and/or animals and are protected from the sun, rain, wind, pilferage, and sand, yet are at all times easily accessible. Furthermore, cameras and other articles which are sensitive to humidity, heat and/or contamination may be safely and conveniently stored within the web without experiencing the difficulties attendant in storing such articles in conventional enclosed beach containers. Finally, valuable articles stored in the preferred embodiment web of the present invention are maintained out of view of passers-by, yet are conveniently displayed to those under the umbrella for convenient selection, deposit or retrieval of those articles.

Accordingly, a primary object of the present invention is the provision of an improved article retaining web for use with beach umbrellas.

Another object of the present invention is the provision of a retaining web which protects articles stored therein from the sun, rain, wind, and sand, yet provides ready access to those articles.

A further object of the present invention is the provision of a low cost article retaining web which may be easily installed in existing beach umbrellas.

A further object of the present invention is the provision of an article retaining web which may be permanently stored in the umbrella to which it has been applied.

These and other objects of the present invention will become apparent from the following more detailed description.

DESCRIPTION OF THE PREFERRED EMBODIMENTS

Figure 2:
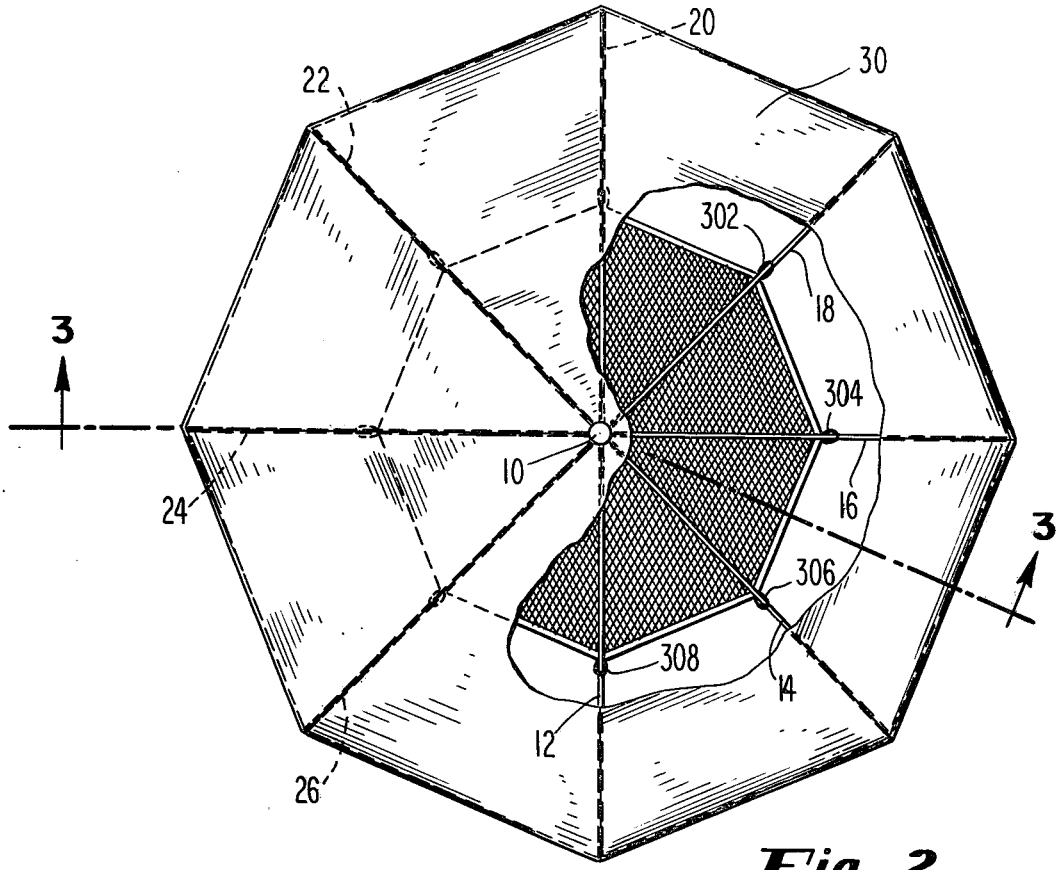
FIG. 2 is a top plan view of the preferred embodiment article retaining web illustrated in FIG. 1 shown attached to a beach umbrella, a portion of the umbrella material being broken away to better illustrate the position of the article retaining web with respect thereto.

Although specific forms of the invention have been selected for illustration in the drawings, and the following description is drawn in specific terms for the purpose of describing these forms of the invention, this description is not intended to limit the scope of the invention which is defined in the appended claims.

Figure 1:
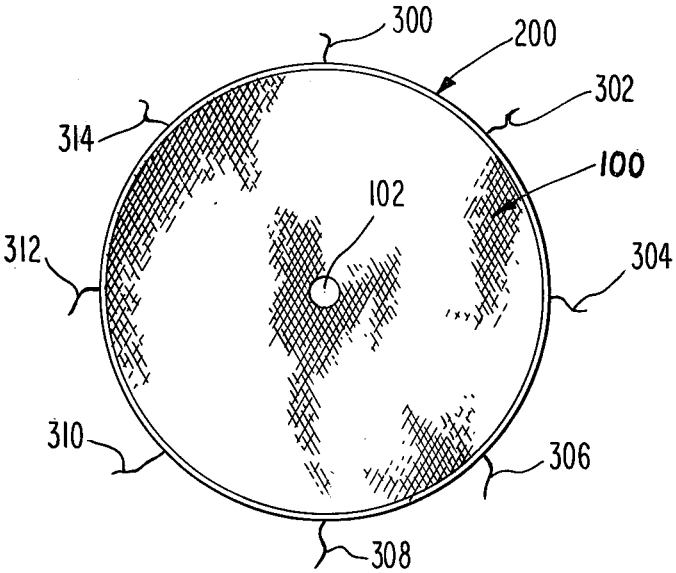
FIG. 1 is a top plan view of the preferred embodiment article retaining web of the present invention.

Referring now to the drawings, and particularly to FIG. 1, the preferred embodiment article retaining web of the present invention comprises a substantially circular net designated generally 100 having a central aperture 102 defined therein which aperture is sized to fit around the pole of the umbrella with which the web is to be used. In the preferred embodiment, this aperture has a diameter of $1\frac{1}{4}$ to 2 inches, preferably $1\frac{3}{4}$ inches. As explained more fully hereinafter, this aperture size is selected not only so that it will fit around the pole and any other hardware which may be disposed therealong at points below the umbrella's strut and yoke position, but also is selected so that when articles are introduced into and retained in the web, that no substantial stresses are created around the perimeter of the aperture which might tend to cause fraying of the net material or otherwise distort the shape of the web. The preferred embodiment net has the aperture cut therein using a heated tube which is driven through the netting to cut and melt the netting around the periphery of the aperture. Fraying of the netting is accordingly prevented and the aperture somewhat reinforced while nonetheless maintaining most of the flexibility of the net in the aperture area.

The preferred embodiment web of the present invention additionally comprises a substantially inelastic reinforcing means for reinforcing the outer perimeter of the net. This may be a substantially continuous, woven strip of material, such as a polypropylene webbing, which preferably has a tensile strength of about eight hundred pounds. The strip, which is between 1 and 3 inches wide, preferably 1½ inches wide, is preferably polypropylene seat-belt webbing, which is folded around the edge of the netting to overlap each side of the netting, and is sewn into place to reinforce the entire periphery of the net material. This woven strip of reinforcing material, designated generally 200 in the drawings, also serves as an anchor for a plurality of attachment means periodically disposed along the reinforcing means, one for each spoke of the umbrella to which the web is to be installed, for suspending the web from the umbrellas spokes. In FIG. 1, eight such ties are illustrated and are numbered 300, 302, 304, 306, 308, 310, 312, and 314, which ties are positioned every 45° with respect to the central aperture 102 to accommodate similar umbrella spoke positions in the umbrella to which this web is to be installed.

Referring now to FIG. 2, the web illustrated in FIG. 1 has been installed in an umbrella which is seen to comprise a central pole 10 having spokes 12, 14, 16, 18, 20, 22, 24, and 26 semetrically radiating therefrom. The spokes, support a fabric covering 30 which is draped thereover and attached at appropriate points to the spokes. In FIG. 2 a portion of the fabric covering 30 is cut away to expose the preferred embodiment article retaining web of the present invention installed thereunder. Ties 302, 304, 306, and 308 which have become visible as a result of this cutaway are shown looped over spokes 18, 16, 14, and 12 respectively. It should be noted that, as viewed from the top, once installed the article retaining web as viewed from the top is no longer circular, but rather is polygonal, in the case of the umbrella shown in FIG. 2 describing an octygon. The reinforcing material as viewed from the top is no longer curved outwardly (convexly) between the attachment sites of the ties partially because of the downward arcing of the reinforcing material between the attachment sites and partially as a result of the elasticity of the net material the weight of which, even without articles retained in the net, tends to draw the reinforcing material into a linear or slightly concave configuration as viewed from the top. This configuration results from the stresses exerted on the net which occur primarily along vectors extending from the central aperture of the net to each attachment site, thereby slightly "stretching" the net material along these axis, with the amount of such stressing decreases uniformly within the netting to a minimum at the axis which bisect each of the spoke locations. In the preferred embodiment, the netting material is nylon raschel knitted material each strand of which is relatively inelastic and has about a three hundred pound tensile strength. The netting itself is knit to have uniform openings defined therein of diameters of between ⅛" to ⅝". The net itself has a tensile strength of fifty pounds, and is, by virtue of the aforementioned mesh, somewhat "elastic." Such mesh is available from Fablock Mills.

Figure 3:
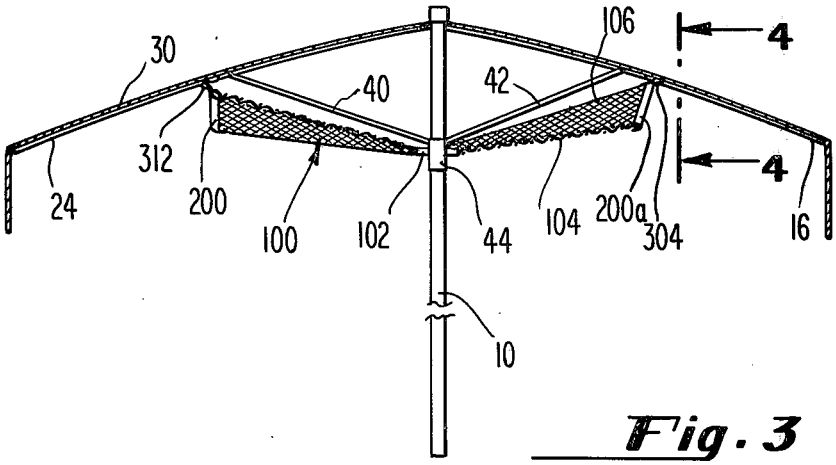
FIG. 3 is a foreshortened cross-section of the umbrella illustrated in FIG. 2 taken as illustrated by the lines and arrows 3—3 in FIG. 2.
Figure 5:
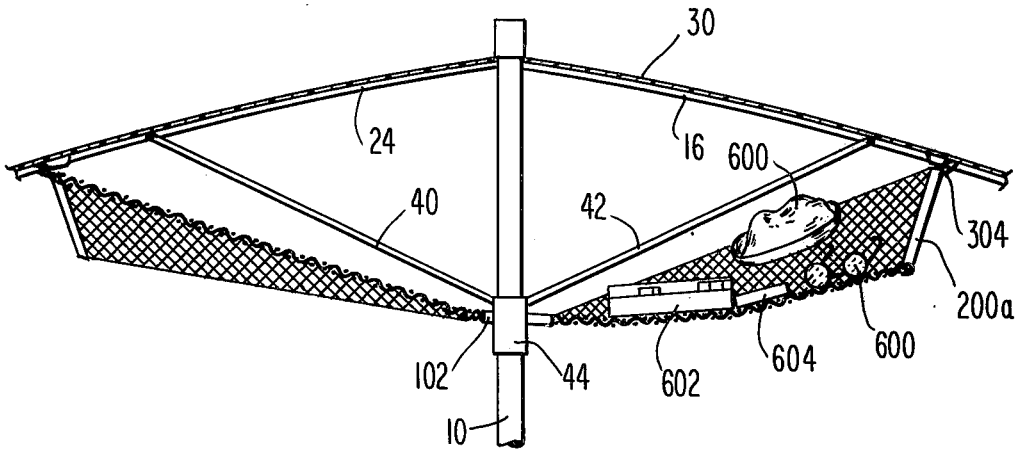
FIG. 5 is an enlarged cross-section of a portion of the umbrella and article retaining web shown in FIG. 3 in which a number of portable articles have been placed for storage.

Referring now to FIG. 3 which is a cross-section of the umbrella and web illustrated in FIG. 2 taken along the lines 3—3, the umbrella will be seen to comprise a plurality of struts such as struts 40 and 42, one for each umbrella spoke, which struts converge at a preselected position along umbrella pole 10 when the umbrella is in the open position. In the embodiment shown in the figures, the struts 40 and 42 are pivotally attached to a yoke 44 which is movable with respect to the pole to open and close the umbrella and which is maintained in the position shown in FIGS. 3 and 5 when the umbrella is in the open position. As with most umbrellas which are manually operated, the yoke 44 extends downwardly below the position of the strut attachment thereto so that hardware associated therewith may be manually grasped to release the yoke with respect to the pole to move the umbrella to the closed position. In the preferred embodiment as shown in FIGS. 3 and 5, the article retaining web is installed at a position such that the aperture thereof is disposed below the attachment position of the struts to the pole but is adjacent to and surrounds the yoke such that manual access to the yoke is maintained.

In FIG. 3, the section has been taken so that the portion of the web shown to the right hand side of the pole is cut along through axis 104 which represents the lowermost radial axis of one of many triangular troughs which are formed by the net 100 between attachment sites along the reinforcing strip 200. The upper surface 106 of the net material 100 shown to the right hand side of pole 10 in FIG. 3 is along a radial axis from the pole which intersects the attachment sites for tie 304. A relative "stretching" of the net material in the vicinity of surface 106 relative to material in the vicinity of axis 104 is shown, which drape is caused by the nature of the net material, the nature of the reinforcing material, such as reinforcing material portion **200*a* shown on the right hand side of FIG. 3, and the web's mode of suspension. Between attachment sites, the reinforcing strip, such as reinforcing strip portion 200*a* seen in FIG. 3**, is oriented in a plane which is substantially perpendicular to the undersurface of its adjacent umbrella material, that is, in a plane which converges slightly towards the base of that pole. This reinforcement strip orientation creates a plurality of scalloped access apertures in this plane between the strip portions and the adjacent umbrella undersurface. In the preferred embodiment, this plane is oriented at 0°–25°, preferably about 15°, with respect to the pole axis. This orientation is substantially maintained, even under load, in order to facilitate access to the top surface of the net.

On the left hand side of the pole 10, the net material designated generally 100 has been sectioned so that a stress axis of the net, that is, an axis extending from the central aperture to intersect an attachment site, such as the attachment site for tie 312, is shown in section, whereas the lower unsectioned surface of the netting shown to the left of the pole defines an unstressed axis which includes the lowest axis in that triangular trough of the retaining web, as described above. In FIG. 3, the central aperture 102 will be seen to be concentrically oriented with respect to both the yoke 44 and pole 10 of the umbrella. Additionally, the ties, such as ties 304 and 312 will be seen to loop over their respective spokes 24 and 16 but under the fabric covering 30 of the umbrella. Additionally, the fabric is seen to extend beyond the edges of the spokes downwardly to form a fringe or other drapped portion of umbrella material, which portions effectively shield the article retaining web and any other articles which may be retained therein out of the view of passers-by. The umbrella material 30 will, of course, act as a canopy over the entire article retaining web and any articles disposed therein to protect those articles from the elements.

Figure 4:
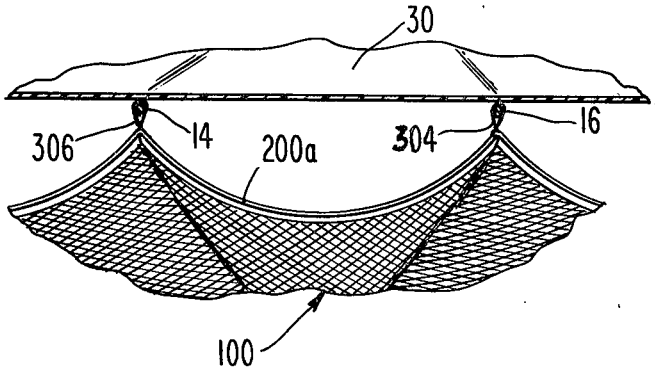
FIG. 4 is a fragmentary cross-section on a greatly enlarged scale of a portion of the umbrella and article retaining web shown in FIG. 3 taken as indicated by the lines and arrows 4—4 in FIG. 3.

In FIG. 4, which is a greatly enlarged fragmentary cross-section taken as indicated by the lines 4—4 in FIG. 3, an article access aperture formed between the attachment sites of ties 304 and 306 is illustrated. This view shows the drape of the reinforcing strip portion 200*a* which is disposed between ties 304 and 306, illustrating the access aperture which is disposed between portion 200*a* and the undersurface of umbrella material 30. Additionally, stress axes radiating inwardly from the attachment sites of ties 304 and 306 within the net designated generally 100 are clearly illustrated in this view.

In FIG. 5, which is a greatly enlarged cross-sectional side view of a portion of the umbrella and article retaining web illustrated in FIG. 3, a plurality of articles are shown being retained in the web. For purposes of illustration a pair of glasses 600, a radio 602, a billfold 604, and a hat 606 are all shown disposed in the trough which is formed between the radial axis extending to the attachment sites of ties 304 and 306. The central aperture 102 formed in the netting will be seen to be shifted somewhat towards the articles retained in the webs, but not so much that unacceptable distortion of the net is produced at this point. Additionally, the opening between the net aperture 102 and the exterior of yoke 44 is only large enough to permit manual axis to the yoke, but is not large enough to present any substantial likelihood that articles contained within the crescent-shaped troughs formed by the web may drop therethrough. Upon loading one or more of the triangular troughs, the positioning of the reinforcing strip portion 200*a* is substantially maintained; rather the weight of these articles is distributed to the adjacent stress axes of the particular trough and through those axes to the respective ties supporting that portion of the net. This means that within practical limits, the loading and unloading of the web with the various articles to be stored therein will not substantially alter the accessibility of the user to those articles. Since the web itself is substantially transparent, a user standing under the umbrella may look through the web to identify the particular article to be removed therefrom and may reach through the crescent-shaped perimetal aperture of the web to grasp and remove the article retained therein.

In order to prevent any substantial interference between the web and the operative portions of the umbrella, and to further enable the web to be folded into the umbrella when the umbrella is not in used, the distance from the center of the net to the end of the ties attached to the spokes will be seen to be substantially greater than the length of each of the generally upwardly extending struts which bridge between the top yoke 44 and appropriate positions along their respective spokes. Upon removal of the articles stored therein, the yoke 44 may be released relative to the pole and lowered, whereupon, as the yoke is lowered, the aperture 102 will drop therewith to enable the umbrella and retaining web to be simultaneously folded for later use.

As mentioned above, each of the components of the preferred embodiment web is relatively inexpensive. The netting is readily available and resists rot and weather-related deterioration. In the preferred embodiment, each of the ties are polypropylene "wire ties" having bulbous projections located therealong which key lock into a key slot formed on a flatened area extending from one end thereof. Such wire ties may be obtained in either five or ten inch lengths in either polypropylene or nylon from Hyloub Industries, Sycamore, Ill., U.S.A. Accordingly, depending upon the particular wire tie utilized, the attachment sites disposed along the reinforcing material will be suspended below the spokes of the umbrella by approximately two to four and a half inches, thereby adding additional access clearance for the deposit or removal of articles from the web.

As seen from the above description, an extremely effective yet low cost article retaining web for use with beach umbrellas is provided which is readily installed and may be stored on any of a variety of types of standard beach umbrellas.

It will be understood that various changes in the details, materials and arrangement of parts which have been herein described and illustrated in order to explain the nature of this invention may be made by those skilled in the art within the principle and scope of the invention as expressed in the following claims.

It will further be understood that the "Abstract of the Disclosure" set forth above is intended to provide a non-legal technical statement of the contents of the disclosure in compliance with the Rules of Practice of the United States Patent and Trademark Office, and is not intended to limit the scope of the invention described and claimed herein.

What is claimed is:

1. An article retaining web for use with a beach umbrella having a central supporting pole, a plurality of spokes pivotally atached thereto, and a plurality of struts extending from a position along said pole generally upwardly to engage said spokes to brace said spokes in the open position of said umbrella, said web comprising:

(a) a substantially circular, flexible net having a central aperture defined therein sized to fit around said pole;

(b) a substantially inelastic reinforcing means for reinforcing the outer perimeter of said net; and (c) a plurality of attachment means periodically disposed along said reinforcing means, one for each spoke of said umbrella, for suspending said web from said spokes.

2. The invention of claim 1 wherein said web is circular having a preselected radius which is substantially greater than the length of said struts.

3. The invention of claim 2 wherein the diameter of said aperture is between 1½" and 2".

4. The invention of claim 2 wherein said attachment means are attached to said spokes at radially symetrical disposed points therealong, which points are located at distances from said position along said pole which are less than said net radius.

5. The invention of claim 4 wherein said attachment means are disposed at attachment sites along said reinforcing means which sites are substantially closer together than their corresponding points of attachment to said spokes, whereby article access points are provided to the upper surface of said web.

6. The invention of claim 5 wherein said reinforcing means comprises a substantially continuous, woven strip of material.

7. The invention of claim 6 wherein said material is polypropylene.

8. The invention of claim 6 wherein said material has a tensile strength of from 100 to 1000 pounds.

9. The invention of claim 5 wherein said net is nylon raschel knitted mesh.

10. The invention of claim 9 wherein said mesh is $\frac{1}{8}''$ to $\frac{5}{8}''$ mesh having a tensile strength of about 50 pounds.

11. The invention of claim 10 wherein said attachment means comprise synthetic wire ties.

12. The invention of claim 4 wherein portions of said reinforcing means defining said access apertures are oriented in planes which are substantially perpendicular to adjacent portions of the umbrella undersurface.

13. The invention of claim 12 wherein said planes are oriented at angles of 0°–25° with respect to the axis of said pole.

14. The invention of claim 13 wherein said planes converge towards the base of said pole.

15. The invention of claim 14 wherein said planes are oriented at an angle of about 15° with respect to the axis of said pole.

16. The invention of claim 8 wherein said strength is about 800 pounds.

* * * * *